US008340340B2

(12) United States Patent
Bogdanov et al.

(10) Patent No.: US 8,340,340 B2
(45) Date of Patent: Dec. 25, 2012

(54) LOUDSPEAKER DRIVER SUSPENSION

(75) Inventors: Oleg Bogdanov, Toronto (CA); Kevin Alexander Stitt, Brampton (CA)

(73) Assignee: Paradigm Electronics Inc., Mississauga (CA)

( * ) Notice: Subject to any disclaimer, the term of this patent is extended or adjusted under 35 U.S.C. 154(b) by 358 days.

(21) Appl. No.: 12/684,046

(22) Filed: Jan. 7, 2010

(65) Prior Publication Data

US 2011/0164782 A1 Jul. 7, 2011

(51) Int. Cl.
*H04R 25/00* (2006.01)

(52) U.S. Cl. ..... 381/398; 381/396; 381/432

(58) Field of Classification Search ..... 381/396, 381/398, 404, 423–424, 432
See application file for complete search history.

(56) References Cited

U.S. PATENT DOCUMENTS

| | | | |
|---|---|---|---|
| 3,676,722 | A | 7/1972 | Schafft |
| 3,997,023 | A | 12/1976 | White |
| D357,480 | S | 4/1995 | Lumsden |
| 5,734,132 | A | 3/1998 | Proni |
| 6,224,801 | B1 | 5/2001 | Mango, III |
| 6,305,491 | B2 | 10/2001 | Iwasa et al. |
| 6,611,604 | B1 | 8/2003 | Irby |
| 6,697,496 | B2 | 2/2004 | Frasl |
| 6,725,967 | B2 | 4/2004 | Hlibowicki |
| 6,851,513 | B2 | 2/2005 | Stead et al. |
| 6,889,796 | B2 | 5/2005 | Pocock et al. |
| 7,054,459 | B2 | 5/2006 | Kuze et al. |
| 7,174,990 | B2 | 2/2007 | Stead et al. |
| 7,275,620 | B1 | 10/2007 | Diedrich et al. |
| 7,397,927 | B2 | 7/2008 | Pircaro et al. |
| 7,438,155 | B2 | 10/2008 | Stead et al. |
| 2003/0228027 | A1 | 12/2003 | Czerwinski |

*Primary Examiner* — Suhan Ni
(74) *Attorney, Agent, or Firm* — Thomas Adams

(57) ABSTRACT

A loudspeaker driver has a diaphragm connected to a surrounding frame by a roll suspension which extends around the diaphragm and within the frame. The roll suspension connects the outer edge of the diaphragm to the inner edge of the frame and flexes as the diaphragm is displaced to and fro axially relative to the frame. In order to provide for better integrity of the roll suspension during its displacement, and reduce unwanted deformation and concomitant distortion, the suspension roll is provided with pleats extending across the roll suspension transversely to the direction of axial movement of the diaphragm to create a series of undulations (peaks and troughs) around the perimeter of the roll suspension. In transverse cross-section, the roll suspension is parabolic. The roll suspension varies continuously between each peak and adjacent trough. Preferably, outer surfaces of each peak and adjacent trough merge to a common point on the outer edge of the roll, while their inner surfaces merge to a common point on the outer edge of the roll, such that the peaks and troughs effectively disappear.

23 Claims, 9 Drawing Sheets

CORRUGATED TUBE

LOUDSPEAKER DRIVER SUSPENSION

TECHNICAL FIELD

This invention relates to loudspeaker drivers and to suspensions therefore. The invention relates especially to drivers having a diaphragm suspended within a frame or so-called basket by a surrounding suspension which flexes as the diaphragm is driven back and forth relative to the frame by the loudspeaker drive unit, usually a voice coil. The invention also relates to a method of producing such a loudspeaker driver suspension.

BACKGROUND

The mechanical structure and function of loudspeaker drivers of the kind which have an electro-acoustic transducer are well known. A flexible surrounding suspension connects the periphery of the diaphragm to the surrounding frame. A second, smaller flexible suspension element connects the centre portion of the diaphragm to the frame; both suspension elements permit a drive unit, usually a "voice coil", to move the diaphragm axially in order to radiate sound waves. Ideally, diaphragm motion is directly proportional to the electrical signal that is fed into the voice coil. Due to dimensional and material limitations, however, this is not attainable in practice. One source of such limitations is the suspension itself because, as the diaphragm is displaced axially, unwanted deformation occurs at certain axial displacements.

The surround suspension performs several functions in a loudspeaker driver, namely, (i) keeping the diaphragm (cone) centered; (ii) sealing the loudspeaker driver in an enclosure or baffle and separating air mass in front of and behind of the cone, thereby avoiding cancellation; and (iii) allowing diaphragm (cone) to move back and forth to produce sound. In order to reproduce low frequencies properly, the diaphragm needs to move a substantial distance without becoming unstable. This has led to the use of a "roll" suspension which flexes back and forth as the diaphragm moves axially. A wider roll (longer in transverse cross-section) will permit greater travel of the diaphragm but, for a given frame, increasing the width of the roll surround suspension reduces the effective radiator area of the diaphragm.

The axial displacement permitted by a roll suspension having a semi-circular profile is limited to about 1.2 times its width because, at that point, the roll is fully stretched into a conical surface. A roll suspension having a parabolic or elliptical profile with a height more than half its width will permit a greater displacement than a semi-circular roll suspension having the same width.

Such a parabolic roll surround suspension is disclosed in U.S. Pat. No. 3,997,023 (White). Although such a roll suspension might permit adequate axial movement, however, at certain displacements unwanted deformation of the suspension itself may occur, causing non-linearity and introducing distortion in the output of the loudspeaker. More particularly, it has been found that "wrinkling" occurs when the diaphragm moves inwards. This is caused by compression of the surround material and is most pronounced with taller and/or wider rolls, such as in subwoofers. Such wrinkles produce sound distortion and can even cause the surround material to break. In practice, therefore, total diaphragm displacement or excursion becomes limited by buckling deformation of the roll.

Several solutions have been proposed for unwanted deformation of the roll suspension while maintaining range of travel and linearity. Some propose the use of reinforcing elements, for example radially-oriented ridges at intervals around the surround, as taught in U.S. Pat. No. 6,725,967 (Dikbowicki), or angularly-oriented notches, as taught by U.S. Pat. No. 7,054,459 (Kuze et al.), or varying the thickness or density at intervals of a compressed neoprene surround as taught in US2003/0228027 (Czerwinski). While this may help in reducing wrinkling/buckling, it does not completely eliminate it because there are still sections of the roll where compressive stress concentrates. In addition there is excessive stress concentration around notches or ridges due to relatively abrupt or sharp transitions in geometry. This could even lead to eventual material failure due to fatigue.

U.S. Pat. No. 7,275,620 (Dietrich et al.) discloses a rectangular loudspeaker in which the generally rectangular surround has notches and ridges defining trapezoidal formations at the corners. This is not entirely satisfactory because relatively sharp transitions would still lead to unwanted stress and non-linearity.

U.S. Pat. No. 6,889,796 (Pocock et al.) discloses a surround suspension in which the cross-section of the roll alternates between semi-circular and semi-elliptical, forming convolutions or undulations. In addition, the fillet where the roll meets the diaphragm varies sinusoidally in phase with the undulations. An obvious drawback of such solution is that the excursion is still limited to that of the semicircular portions of the roll. Also stress would occur around the transitions, leading to deformation.

Yet another solution, disclosed in U.S. Pat. No. 7,397,927 (Pircaro et al.), adds angularly—(as opposed to radially-) oriented convolutions to a base profile of the roll. While this might help to reduce wrinkling/buckling, it is not entirely satisfactory because it would tend to introduce torsional stress into the drive system and have an adverse effect upon linearity.

With a view to improving high frequency stability by preventing unwanted deformation in the diaphragm, U.S. Pat. No. 6,697,496 (Frasl) discloses a low profile suspension having pleats along its length. The pleats are divided into three equal 120 degree segments, with the pleats in each segment parallel to each other but oriented at an angle of 120 degrees to those in the other two segments. While this might help to reduce unwanted diaphragm oscillations at higher frequencies, the arrangement would not be entirely satisfactory because its low profile would mitigate against it use for low frequency loudspeakers and stress concentrations would occur between adjacent pleats having different orientations, i.e., endmost pleats of the different segments.

U.S. Pat. Nos. 6,851,513 and 7,174,990 (Stead et al.) disclose a surround suspension whose peak varies in shape around the circumference, either by alternating between a semi-circular cross-section and other conic section that is greater in height, or by varying the radius of the peak sinusoidally along the circumference. Neither option is entirely satisfactory because the uniform sections would tend not to reduce buckling completely and/or relatively sharp transitions between peaks and uniform roll sections would lead to stress and distortion.

U.S. Pat. No. 7,438,155 (Stead et al.) discloses a loudspeaker drive unit similar to those disclosed in their abovementioned patents. In this case, however, the peak of the roll surround varies sinusoidally around the perimeter while maintaining constant height, but its cross-sectional shape varies. This too would not be entirely satisfactory because the transitions between peaks and troughs would still introduce stress and distortion.

In effect, convolutions transform material compression into bending, which flexible materials are designed to do, but known configurations are not entirely satisfactory because the geometry of the convolutions does not adequately reduce stress at transitions, leading to deformation stress in the suspension material and concomitant distortion in the loudspeaker driver output.

SUMMARY OF INVENTION

An object of the present invention is to at least mitigate the deficiencies of known such loudspeaker drivers, or at least provide an alternative.

According to one aspect of the present invention, a loudspeaker driver has a diaphragm suspended within a frame by a surrounding roll suspension that flexes as the diaphragm is driven back and forth relative to the frame by the loudspeaker drive unit, the roll suspension having a cross-section that is a non-circular section through a cone, the height of the roll suspension medial its inner and outer edges alternating between higher and lower levels to define peaks and troughs,

- the cross-sectional shape being substantially the same throughout the length of the suspension around the perimeter of the driver,
- the suspension varying continuously between adjacent peaks and trough such that peaks and troughs merge smoothly into each other.

The use of a conic cross-section whose height is greater than half the width, provides a greater range of displacement than a semi-circular cross-section suspension design of the same width.

Preferably, the non-circular conical sectional shape is a parabola.

Adding pleats adds additional material to the roll suspension thereby increasing its mass. Since additional mass can be detrimental to performance, it is desirable to keep this increase to a minimum. It follows that the lowest high-low ratio to eliminate unwanted deformation is preferable. The ratio between higher and lower sections (peaks and troughs) of the roll suspension is greater than 1:1, since 1:1 would result in no difference between the higher and lower profiles and therefore no undulations. Preferably, the ratio also is no more than about 2:1, since a higher/lower ratio of 2:1 or greater would result in pleats twice as high as the base profile (troughs) and might introduce stability problems, specifically unwanted side-to-side oscillation of peaks, creating unwanted distortion. In preferred embodiments, a high/low ratio of approximately 1.2:1 is preferred, especially where the conical section is parabolic.

The transitions between peaks and troughs may comprise a polyline comprising straight lines joined at the peaks by arcs and at the troughs by arcuate fillets.

Advantageously, the undulations in the roll suspension minimize undesirable compressive buckling load, allowing controlled bending load while the smooth transition between the lower cross-section and the higher cross-section reduces the wrinkling/buckling effects.

Preferably, the higher and lower parabolas share the same end points so that, at the inner and outer edges of the suspension, where the suspension is attached to the diaphragm and frame, respectively, the corrugations (pleats) disappear. Otherwise, the "pleats" would tend to be subject to undesirable deformation.

The number of peaks should be kept to the minimum number required to allow them to adequately perform their function, without introducing additional unnecessary mass. In preferred embodiments of the invention, the angular separation between peaks is about five (5) degrees.

The suspension cross-section variation (i.e. pleats) profile can be presented as a set of line segments joined together by fillets. A larger angle between line segments will result in fewer pleats; a smaller angle will result in more pleats. For a high/low ratio of 1.2:1 an angle somewhere between 60 and 120 degrees provides desired results.

According to a second aspect of the present invention, there is provided a method of designing a loudspeaker driver suspension comprising the steps of generating a lofted surface as a straight undulating or corrugated tubular member having a profile with peaks and troughs having a prescribed height ratio and length corresponding to the perimeter of the diaphragm, shaping the tubular member to the outer perimeter of the diaphragm and attaching surface attachments, such as inner and outer flanges, for adhering or over moulding, for connecting the inner and outer edge areas of the suspension to the diaphragm and frame, respectively.

The foregoing and other objects, features, aspects and advantages of the present invention will become more apparent from the following detailed description, taken in conjunction with the accompanying drawings, of preferred embodiments of the invention, which are described by way of example only.

BRIEF DESCRIPTION OF THE DRAWINGS

In the drawings, identical or corresponding elements in the different Figures have the same reference numeral.

DESCRIPTION OF PREFERRED EMBODIMENTS

Figure 1:
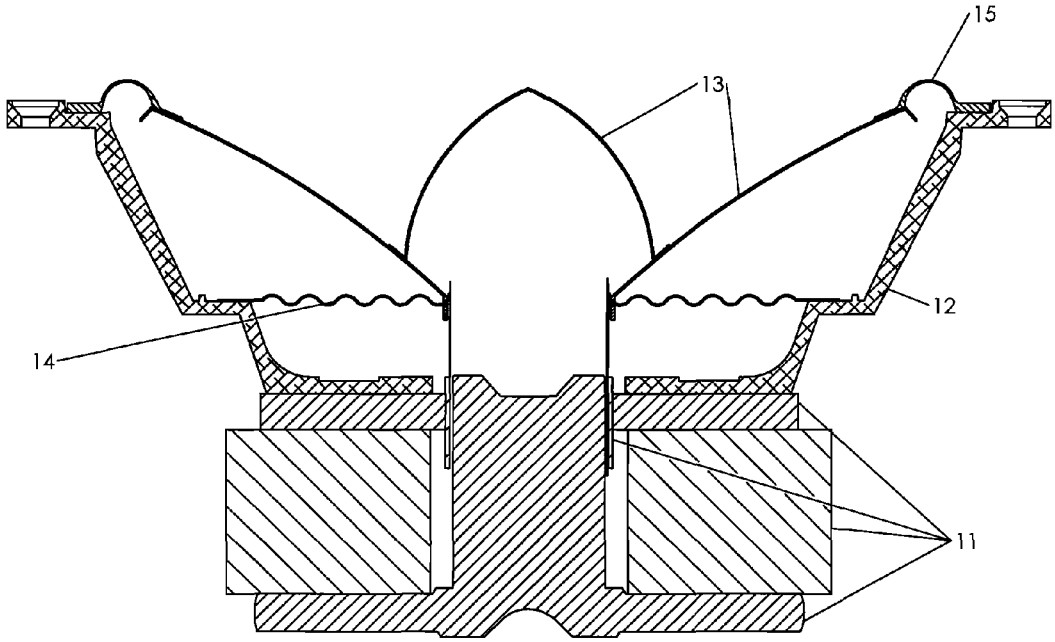
FIGURE 1. (PRIOR ART)
FIG. 1, labelled PRIOR ART, is a cross-sectional view of a typical electro-dynamic loudspeaker driver.

Referring first to FIG. 1, labelled PRIOR ART, a typical electro-dynamic loudspeaker driver comprises a magnetic motor system 11, frame 12 (sometimes called a "basket"), an axially-movable diaphragm 13, centering element 14 (sometimes called a "spider"), and flexible surrounding roll suspension 15. The inner edge of the flexible roll suspension 15 is attached to the outermost edge of the axially movable diaphragm 14 and the outer edge of the roll suspension 15 is connected to the rim flange of the frame 12. Consequently, the width of the surrounding roll suspension 15 is limited to the annular gap between the edge of the diaphragm 14 and the flange of frame 12.

Figure 2:
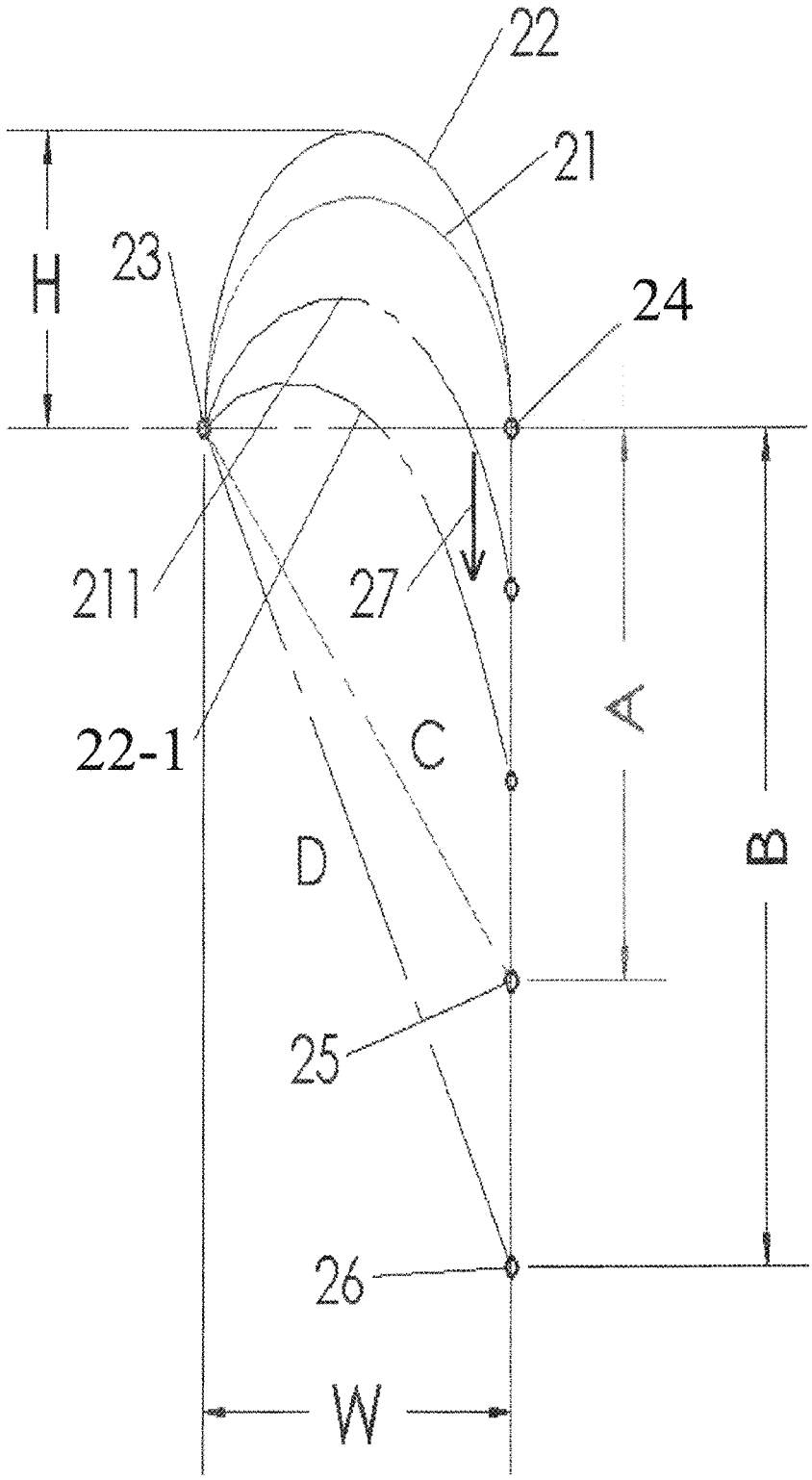
FIG. 2 shows cross-sectional views comparing flexing of a parabolic cross-section suspension profile and a semi-circular cross-section suspension profile.

FIG. 2 illustrates schematically and in cross-section a semi-circular suspension roll profile 21 and a parabolic suspension roll profile 22, initially in the resting or neutral position. The frame attachment is represented by point 23 and the diaphragm attachment is represented by point 24, spaced apart by the width W. Displacement of the diaphragm downwards, as shown by arrow 27, causes the curved suspension profile to begin to unfold as shown in intermediate positions by dashed lines 21-1 and 22-1 for profiles 21 and 22, respectively. When the diaphragm attachment point 24 reaches the displacement point 25, the semi-circular cross-section profile 21 stretches into a straight line and thus reaches its maximum displacement A. However, the parabolic cross-section profile 22 does not become straight, and thus reach its maximum displacement B, until the diaphragm attachment point 24 reaches displacement point 26. It is apparent that, for a given width W, the displacement range of the parabolic profile 22 is greater than the displacement range of the semi-circular profile 21 (by B-A).

The arc length C for semi-circular cross-section suspension 21 is:

$$C=\Pi*W/2=1.571*W$$

The excursion limit A for semi-circular cross-section suspension can be expressed by the following formula:

$$A=\sqrt{C^2-W^2}=\sqrt{(\Pi*W/2)^2-W^2}=\sqrt{W^2*((\Pi/2)^2-1)}=W*\sqrt{(\Pi/2)^2-1}=1.211*W$$

The segment length D for parabolic cross-section suspension 22 can be approximated by the following formula:

$$D=\sqrt{W^2/4+4*H^2}+W^2/(8*H)*\arcsin h(4*H/W)$$

For a width to height ratio of parabolic profile of 1.5, for example, H can be substituted by W/1.5, so:

$$D=1.744*W$$

The excursion limit B for parabolic cross-section suspension can be expressed as follows:

$$B=\sqrt{D^2-W^2}=\sqrt{(1.744*W)^2-W^2}=W*\sqrt{1.744^2-1}=1.429*W$$

Since, for the same width to height ratio of 1.5:1, B=1.429*W and A=1.211*W, these calculations demonstrate that diaphragm displacement limits are greater for the parabolic geometry than for a semi-circular geometry.

Figure 3:
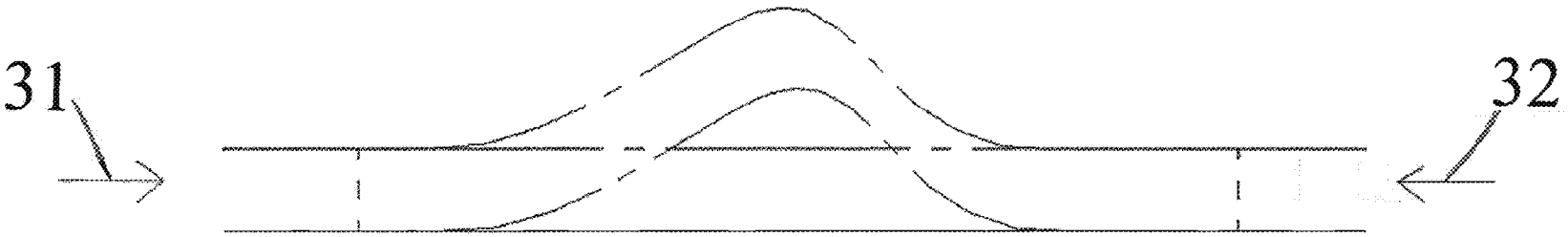
FIG. 3 illustrates undesirable deformation of such suspensions as they flex.

In order to take advantage of extended parabolic suspension displacement range, however, it is necessary to address undesirable deformation which becomes evident during downward motion of the diaphragm. Thus, FIG. 3 illustrates a segment of the roll suspension 15 of the driver shown in FIG. 1 at its maximum excursion. Arrows 31 and 32 depict the compressive forces acting in opposite directions upon the suspension. FIG. 3 demonstrates how undesirable deformation occurs as the material on the outer perimeter of the roll suspension is forced into a smaller perimeter. Compression forces are indicated by the arrows 31 and 32.

Figure 4:
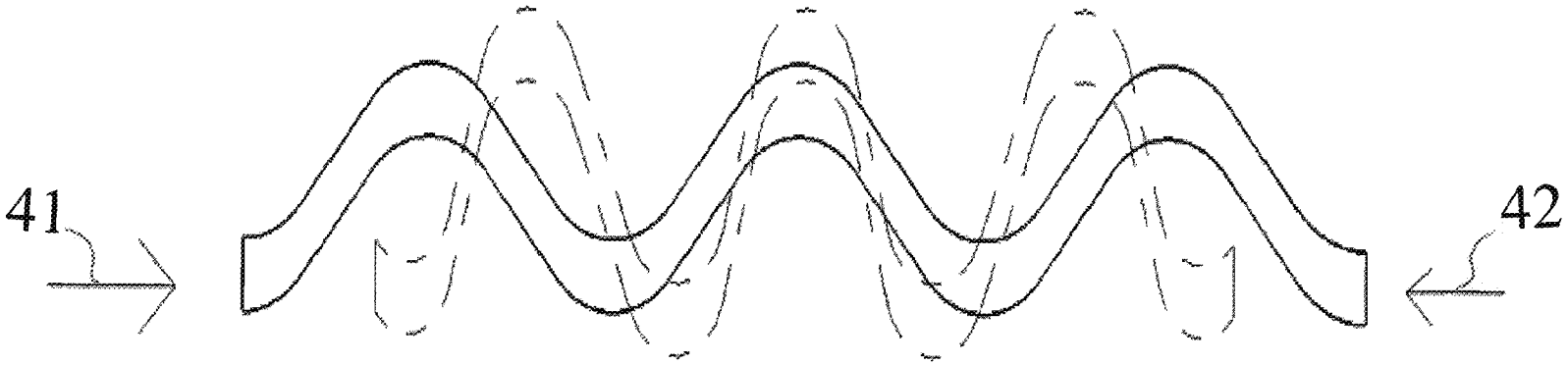
FIG. 4 illustrates how pleats or undulations control undesirable deformation.

FIG. 4 illustrates how pleats extending generally radially across the width of the roll suspension will simply be forced closer together as the diaphragm displaces downwards, and absorb compression forces 41 and 42, tending to reduce unwanted deformation.

Figure 5:
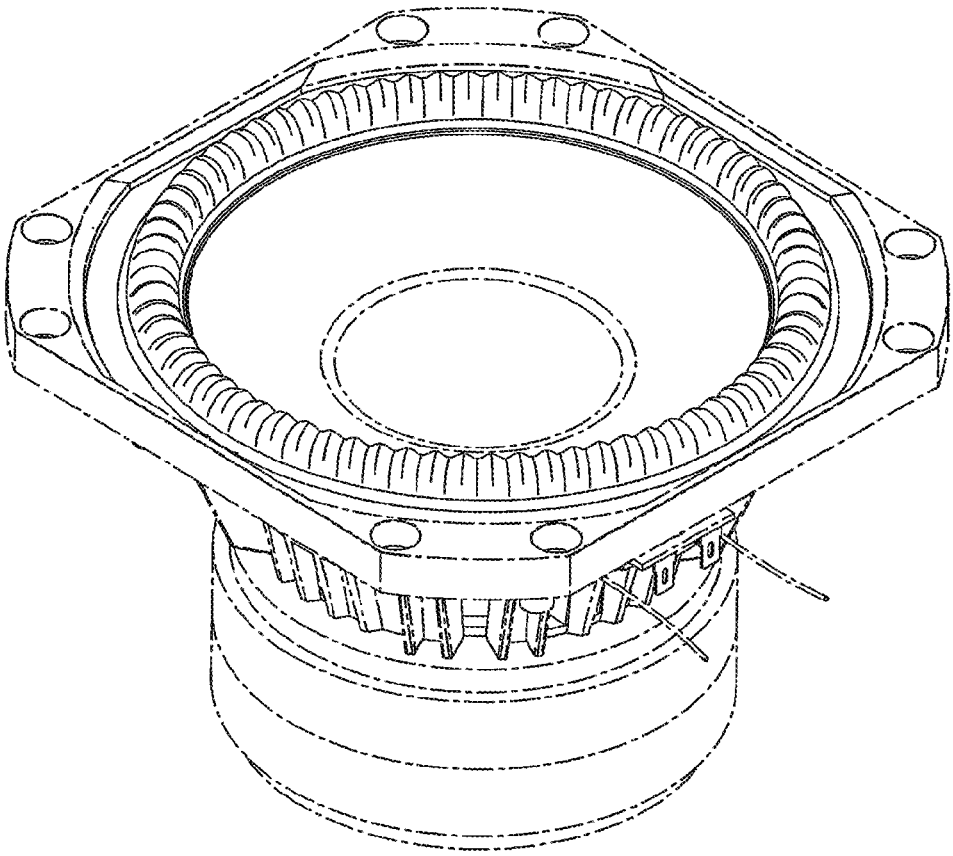
FIG. 5 is a pictorial view of a loudspeaker driver embodying the present invention and having a pleated roll surround.

FIG. 5 illustrates a loudspeaker driver embodying the present invention which has a magnetic motor system 11, frame or "basket" 12, axially-movable diaphragm 13, centering element or "spider" 14. Flexible surrounding roll suspension 16 has its inner edge attached to the outermost edge of the axially movable diaphragm 14 and its outer edge connected to the rim flange of the frame 12. The profile of the roll suspension 16 differs, however, from that shown in FIG. 1, and those of known loudspeaker drivers, as will be explained in more detail with reference also to FIGS. 6A to 9B.

Figure 6A:
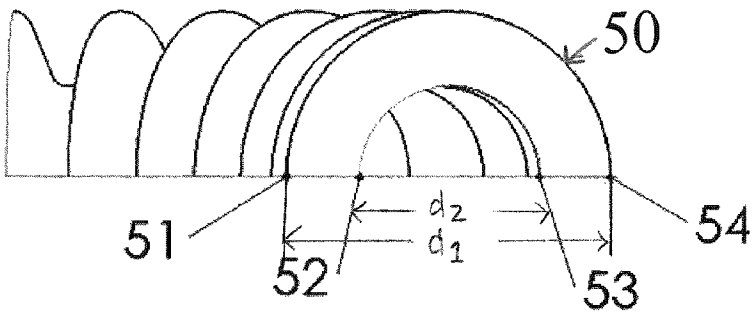
Figure 6A (PRIOR ART)
FIGS. 6A and 6B illustrate schematically portions of a corrugated tube and pleated suspension embodying the invention, respectively.

FIG. 6A illustrates, for convenience of description, a short section of a diametrically-sliced corrugated tube 50. Seen endwise, each corrugation is annular, with an outer diameter d1 and an inner diameter d2. Even if the tube 50 were a section of a roll suspension of the kind disclosed by Stead et al. (supra), which alternates between a semi-circular "lower" section and a parabolic "higher" cross-section, the base of each "corrugation" would have a diameter d2 while the base of each parabola would have a diameter D1. Transitions between these corrugations would lead to stress concentrations and unwanted deformation.

Figure 6B:
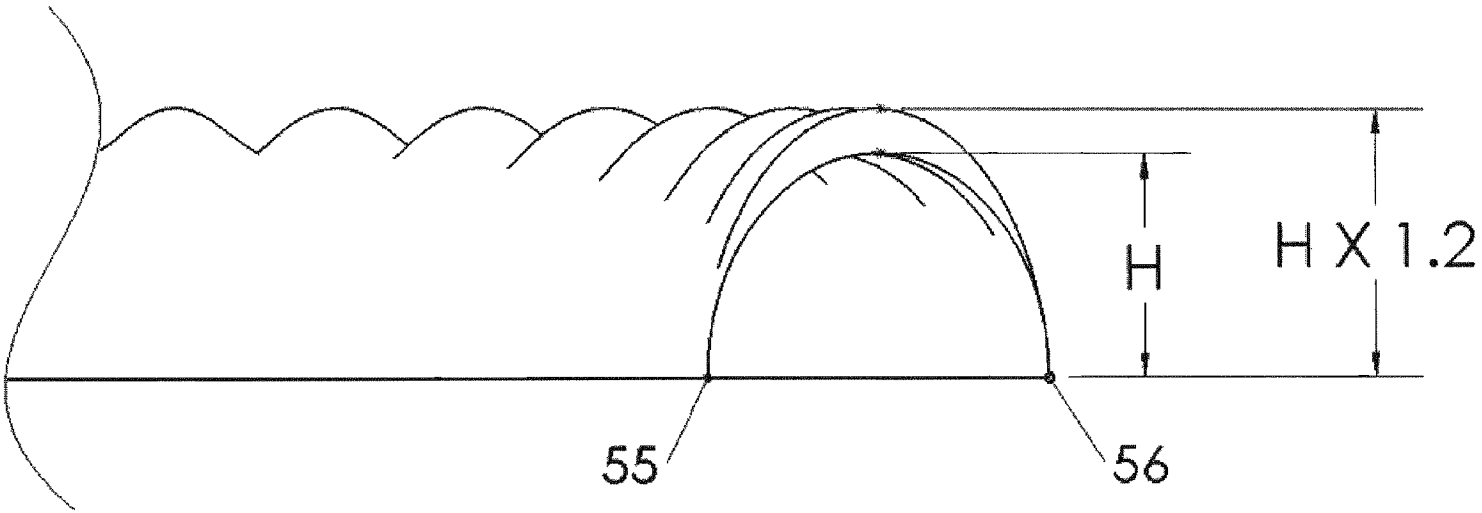

In contrast, and as shown in FIG. 6B, in a roll suspension 16 embodying the present invention the pleats have the same shape (both parabolic in this embodiment), and have the same width at the base, i.e., the respective bases of each peak and the adjoining trough are conjoined at inner attachment point 55 and, likewise, at outer attachment point 56. The pleats are formed in a fashion similar to a corrugated tube cut in half, by continuously varying the profile between the base cross-section and the increased height cross-section. Merging, in effect, points 51 and 52 into point 55, and points 53 and 54 into point 56, maintain flexibility in the hinge points (i.e., the lines through points 55 about which the roll suspension flexes relative to the diaphragm and the line through points 56 about which the roll suspension 16 flexes relative to the flange of frame 12, and as a result inhibits undesirable deformation due to vertical compression.

The high/low ratio (between parabolas) should be kept to a minimum in order to limit suspension mass increase due to extra material, but, obviously, cannot be equal to or lower than 1:1. In practice, a high/low ratio of 1.2:1 (between the two parabola heights) is adequate/preferred.

Figure 7:
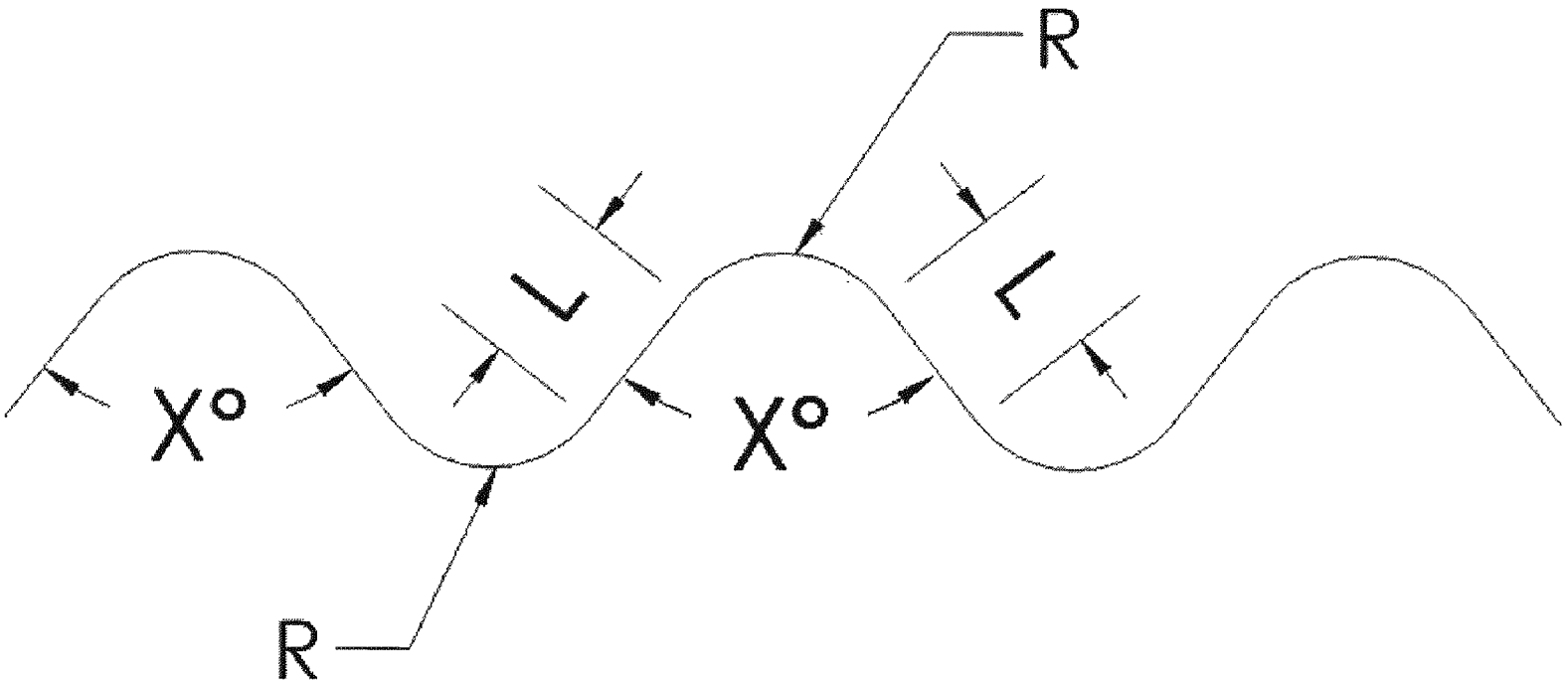
FIG. 7 illustrates the transition between base and increased height parabolic cross-sections of the suspension of FIGS. 5 and 6B.
Figure 8A:
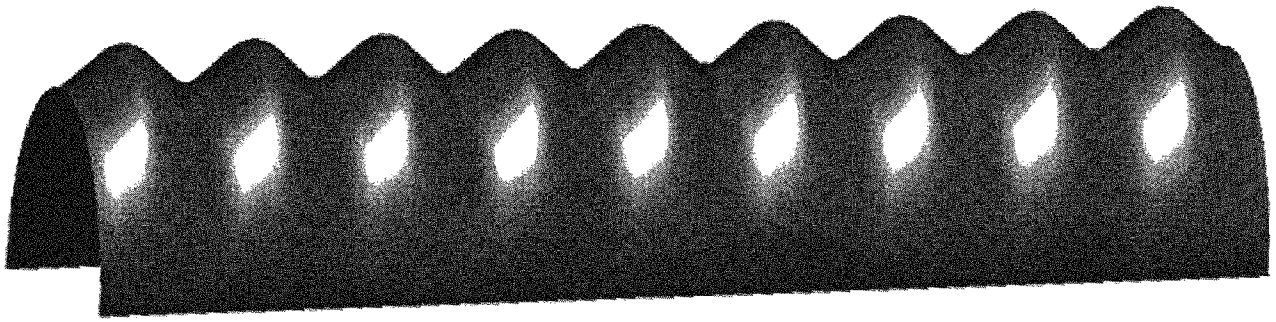
FIGS. 8A and 8B illustrate unfolded pleated parabolic suspension loft as created during the design process.
Figure 8B:
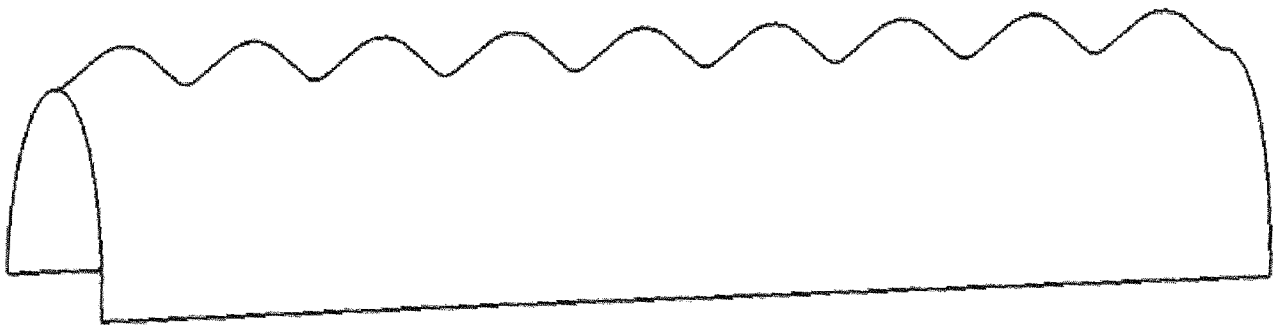
Figure 9A:
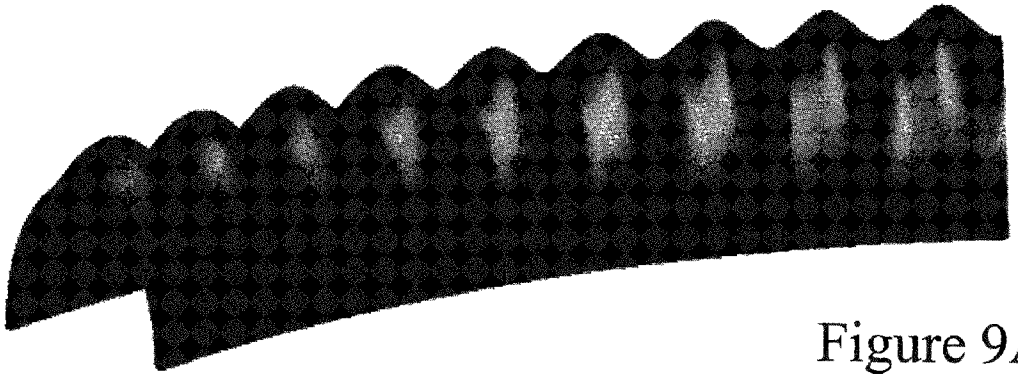
FIGS. 9A and 9B illustrate curvature of the pleated parabolic suspension loft during the design process to conform it to the outer perimeter of the diaphragm.
Figure 9B:
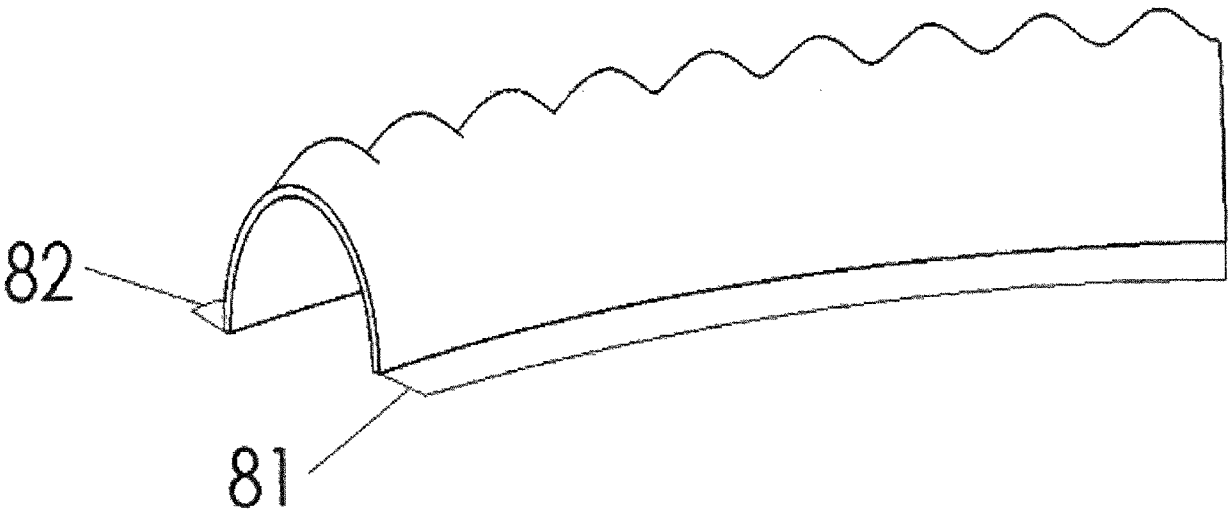

FIG. 7 shows the suspension cross-section along the circumferential line connecting apexes of the two parabolic cross-sectional profiles. It can be presented as a set of line segments joined by arcuate fillets. The angle $X^O$ between adjacent line segments determines the number of pleats along the suspension; a larger angle results in a smaller number of pleats, while a smaller angle results in a larger number of pleats. For the high/low ratio of 1.2:1 mentioned above, adequate results are provided if the angle $X^O$ between line segments is in the range from about 30 to about 150 degrees.

The method of designing the roll suspension 16 will now be described with reference to FIGS. 7, 8A, 8B, 9A and 9B, which illustrate steps involved in generating the three-dimensional virtual geometry necessary to design the pleated parabolic suspension for manufacture. First, using the design and geometry considerations mentioned above, the lofted surface in a straight profile is created, as seen in the optimized parabolas and line segments shown in FIG. 7 and the short section illustrated pictorially in FIGS. 8A and 8B. (The term "loft" is commonly used in computer-aided design programs). The lofted surface must be the proper arc length to match the perimeter of the diaphragm 13. As illustrated pictorially in FIGS. 9A and 9B the straight profile lofted surface is shaped to match the outer perimeter of the diaphragm 13. Lastly, surface attachments, such as flanges 81 and 82 shown in FIG. 9B, for gluing, or over moulding, are added for connecting the inner and outer edge areas of the suspension to the diaphragm and frame, respectively.

An advantage of roll suspensions embodying the present invention, in which the profile varies continuously as opposed to uniform sections separated by peaked or notched sections, and transitions are smooth without sharp corners or abrupt changes, stress concentrations are substantially avoided with a consequent reduction in buckling/wrinkling.

To maintain target excursion for a given width of the roll suspension, cross-section of the lowest part of the roll must be a non-circular conic section, preferably parabolic (either a single parabola or a combination of parabolic arches joined by the radius on top) with sufficient length; then the peaks of continuously variable shape are added. This is in contrast to starting with the desired profile and adding notches or valleys, which will cut into desired excursion.

Although embodiments of the invention have been described and illustrated in detail, it is to be clearly understood that the same are by way of illustration and example only and not to be taken by way of limitation, the scope of the present invention being limited only by the appended claims.

The invention claimed is:

1. A loudspeaker driver having a diaphragm suspended within a frame by a surrounding roll suspension that flexes as the diaphragm is driven back and forth relative to the frame by the loudspeaker drive unit, the roll suspension having a cross-section that is a non-circular section through a cone, the height of the roll suspension medial its inner and outer edges alternating between higher and lower levels to define peaks and troughs, the cross-sectional shape being substantially the same throughout the length of the suspension around the perimeter of the driver, the suspension varying continuously between adjacent peaks and troughs such that peaks and troughs merge smoothly into each other.

2. A loudspeaker driver according to claim 1, wherein inner surfaces of adjacent ones of the peaks and troughs converge to merge together at the innermost edge of the roll and outer surfaces of adjacent ones of the peaks and troughs converge to merge together at the outermost edge of the roll.

3. A loudspeaker driver according to claim 1, wherein the non-circular cross-sectional shape is parabolic.

4. A loudspeaker driver according to claim 1, wherein the ratio between the peak height and trough height is no more than about 2:1.

5. A loudspeaker driver according to claim 1, wherein the ratio between peak height and trough height is about 1.2:1.

6. A loudspeaker driver according to claim 1, wherein transitions between peaks and troughs follow a polyline comprising straight lines joined at the peaks by arcs and at the troughs by arcuate fillets.

7. A loudspeaker driver according to claim 1, wherein adjacent peaks are separated angularly by about five (5) degrees.

8. A loudspeaker driver according to claim 1, wherein, when the suspension cross-section is approximated as a set of line segments joined together by arcs and fillets at peaks and troughs, respectively, the angle between adjacent line segments is between 60 and 120 degrees.

9. A loudspeaker driver according to claim 1, wherein the non-circular cross-sectional shape is elliptical.

10. A loudspeaker diaphragm suspension with pleats created by loft transitioning between a base cross-section and an increased height cross-section, the base cross-section and the increased height cross-section each being a non-circular cross-section of a cone, the suspension having a cross-sectional profile that varies continuously between each peak and adjacent trough so as to substantially eliminate unwanted stress-induced deformation during displacement of the diaphragm suspension when in use.

11. A loudspeaker diaphragm suspension as claimed in claim 10, wherein the width-to-height ratio of the base non-circular cross-section is less than 2:1.

12. A loudspeaker diaphragm suspension as claimed in claim 11, wherein each transition between adjacent high and low non-circular cross-sections is a set of line segments joined by arcs at high cross-sections and arcuate fillets at low cross-sections.

13. A loudspeaker diaphragm suspension as claimed in claim 12, wherein the angle between line segments representing transition between high and low non-circular cross-sections is in the range of 30 to 150 degrees.

14. A loudspeaker diaphragm suspension as claimed in claim 11, wherein the ratio between the increased height non-circular cross-section and the base non-circular cross-section is between 1:1 and 2:1.

15. A loudspeaker diaphragm suspension as claimed in claim 11, wherein each pleat gradually decreases from its apex to inner and outer attachment hinge points, respectively, effectively disappearing completely at the hinge points.

16. A loudspeaker driver diaphragm suspension according to claim 10, wherein the non-circular cross-sectional shape is elliptical.

17. A loudspeaker driver diaphragm suspension according to claim 10, wherein the non-circular cross-sectional shape is parabolic.

18. A suspension for a loudspeaker driver having a diaphragm suspended within a frame by said suspension, the suspension surrounding the diaphragm and flexing as the diaphragm is driven back and forth relative to the frame by a loudspeaker drive unit, the suspension having a cross-section that is a non-circular cross-section of a cone, the height of the roll suspension medial its inner and outer edges alternating between higher and lower levels to define peaks and troughs, the non-circular cross-sectional shape being substantially the same throughout the length of the suspension around the perimeter of the driver, the suspension varying continuously between adjacent peaks and trough such that peaks and troughs merge smoothly into each other.

19. A loudspeaker driver suspension according to claim 18, wherein inner surfaces of adjacent ones of the peaks and troughs converge to merge together at the innermost edge of the roll and outer surfaces of adjacent ones of the peaks and troughs converge to merge together at the outermost edge of the roll.

20. A loudspeaker driver suspension according to claim 18, wherein the non-circular cross-sectional shape is parabolic.

21. A loudspeaker driver suspension according to claim 18, wherein the ratio between the peak height and trough height is no more than about 2:1.

22. A loudspeaker driver according to claim 21, wherein the ratio between peak height and trough height is about 1.2:1.

23. A suspension according to claim 18, wherein the non-circular cross-sectional shape is elliptical.

* * * * *